United States Patent [19]

Reynolds et al.

[11] 4,207,025

[45] Jun. 10, 1980

[54] INFLATABLE FAN HOUSING

[75] Inventors: Clifton J. Reynolds, Sacramento; Ralph H. Shultz, Jr., Roseville, both of Calif.

[73] Assignee: Aerojet-General Corporation, La Jolla, Calif.

[21] Appl. No.: 5,367

[22] Filed: Jan. 22, 1979

[51] Int. Cl.[2] ..... F04D 29/44

[52] U.S. Cl. ..... 415/200; 415/219 A

[58] Field of Search ..... 415/200, 219 C, 219 A, 415/197, 204

[56] References Cited

U.S. PATENT DOCUMENTS

| | | | |
|---|---|---|---|
| 2,382,839 | 8/1945 | Wuensch | 415/197 |
| 2,672,821 | 3/1954 | Montgomery | 415/196 |
| 2,759,428 | 8/1956 | Kirby | 415/197 |
| 2,973,716 | 3/1961 | Thomas | 415/197 X |
| 3,018,736 | 1/1962 | Clay | 415/197 |
| 3,115,099 | 12/1963 | Clay | 415/197 |
| 3,146,722 | 9/1964 | Warman | 415/197 X |
| 3,381,617 | 5/1968 | Wright | 415/197 |
| 3,607,600 | 9/1971 | Schreter et al. | 415/197 X |
| 3,990,808 | 11/1976 | Isaacson | 415/200 X |

*Primary Examiner*—Leonard E. Smith
*Attorney, Agent, or Firm*—John S. Bell

[57] ABSTRACT

An inflatable spiral or snail shell shaped fan housing comprised of flexible surface supported by a rigid housing back wall and by an impeller shroud attached to that back wall, is described herein.

2 Claims, 2 Drawing Figures

INFLATABLE FAN HOUSING

BACKGROUND OF THE INVENTION

1. Field of the Invention

Fans, compressors, superchargers, blowers and the like all referred to herein generically as fans.

2. Brief Description of the Prior Art

It is desirable for fans to be uncomplicated, lightweight, economic, compact, durable and easily reparable, and to provide reliable, low stress, leak free, high efficiency performance. Many different designs are known that favor different ones of these objects in different proportions, including designs that utilize different rigid scroll and snail shell shaped housings. Prior rigid designs intended to provide high pressure, high flow rate, and/or high-efficiency performance are complex, expensive, and heavy. Thick rigid walls and/or extensive strut frames are used to contain the high pressures and flows, maintain sufficient tolerances to prevent leakage or back flow between the impeller and housing from the high pressure side of the impeller, prevent the impeller from striking the housing during operation, prevent vibration, and otherwise accommodate high-efficiency performance.

The prior art teaches that some cost and weight savings can be achieved by construction of a centrifugal fan with a cylindrical rotor disposed in an inflatable cylindrical scroll. But, the cylindrical configuration of the rotor and scroll limit the overall benefit of the design. A moderately extensive frame is required to prevent the scroll from falling into the rotor when the fan is not in operation, and to provide an effective flow path and good interconnection between the rotor section and outlet duct. There is only a limited reduction in volume and benefit for purposes such as shipment from one location to another when the fan is not in operation and the housing is deflated. And, the edges or corners of cylindrical housings produce uneven distributions of forces across the housing surfaces that generally either limit fan efficiency or require a sturdier construction than would otherwise be needed.

SUMMARY OF THE INVENTION

This invention provides a fan housing that achieves all of the general objectives of fan design listed above in good proportion. The housing is comprised of a flexible skin or surface that collapses when the fan is not in operation and is inflated by air from the fan rotor when the fan is in operation to form a snail shell type spiral encircling the rotor. The flexible surface is secured to an appropriate support member adjacent the impeller blade, such as a rigid disk shaped back wall, and to an impeller shroud. The shroud is secured to the back wall or other support by spacers that leave a slot between the support member and shroud for flow of air from the impeller. In operation, air flows across the impeller, through the slot between the back wall and shroud, into the collapsible housing, and around the snail shell shaped spiral defined by that housing to an outlet.

The fan housing is uncomplicated, lightweight and economic. A flexible skin or surface and minimal frame or other support structure that will keep that surface from falling into the rotor when the fan is not in operation form substantially the entire housing. The flexible surface of a high pressure, high flow embodiment of the fan illustrated herein having a four foot diameter impeller and nine foot diameter housing will only weight about 50 lbs. And many flexible materials that are sufficiently nonporous to contain the air flow, easy to work with, and puncture and tear resistant, are readily and economically available. The attachment or anchoring of the flexible surface to a back wall and shroud laying along the rotor provides a compact form that collapses to a minimal size when not in operation. The housing is very resistant to tears and punctures because it is flexible, and is easily patched if any do occur. The snail shell shape has a smooth curvature that provides low stress, high efficiency, vibration free performance by causing forces to be uniformally distributed across the housing surface in a manner that places the housing components in tension, and does not create any localized high stresses, vibrations, or flapping of the flexible surface.

DETAILED DESCRIPTION OF THE PREFERRED EMBODIMENT

Figure 1:
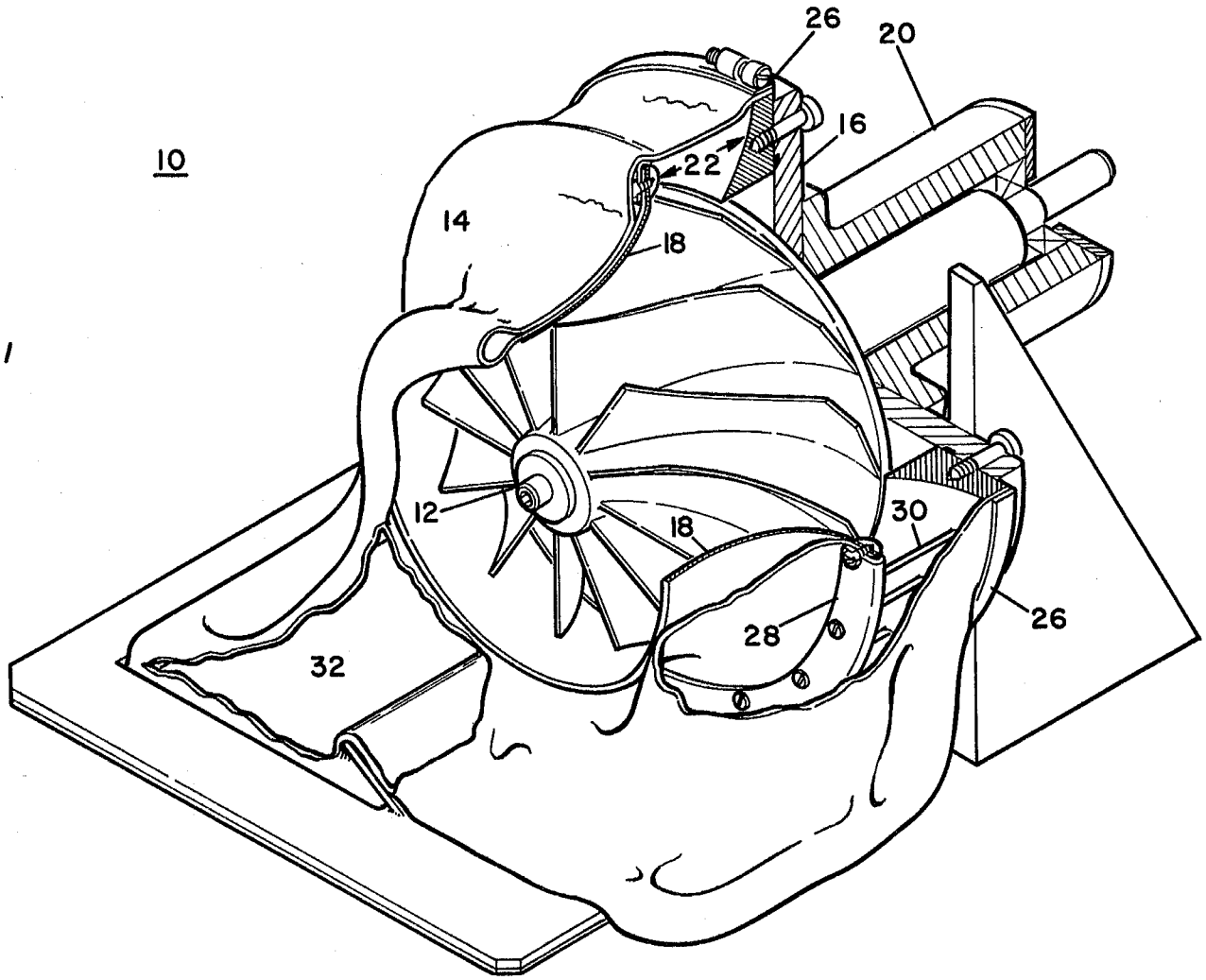
FIG. 1 is a partially cutaway schematic, perspective illustration of one embodiment of an inflatable housing fan of this invention in which the housing is shown in the collapsed or deflated position assumed when the fan is not in operation.
Figure 2:
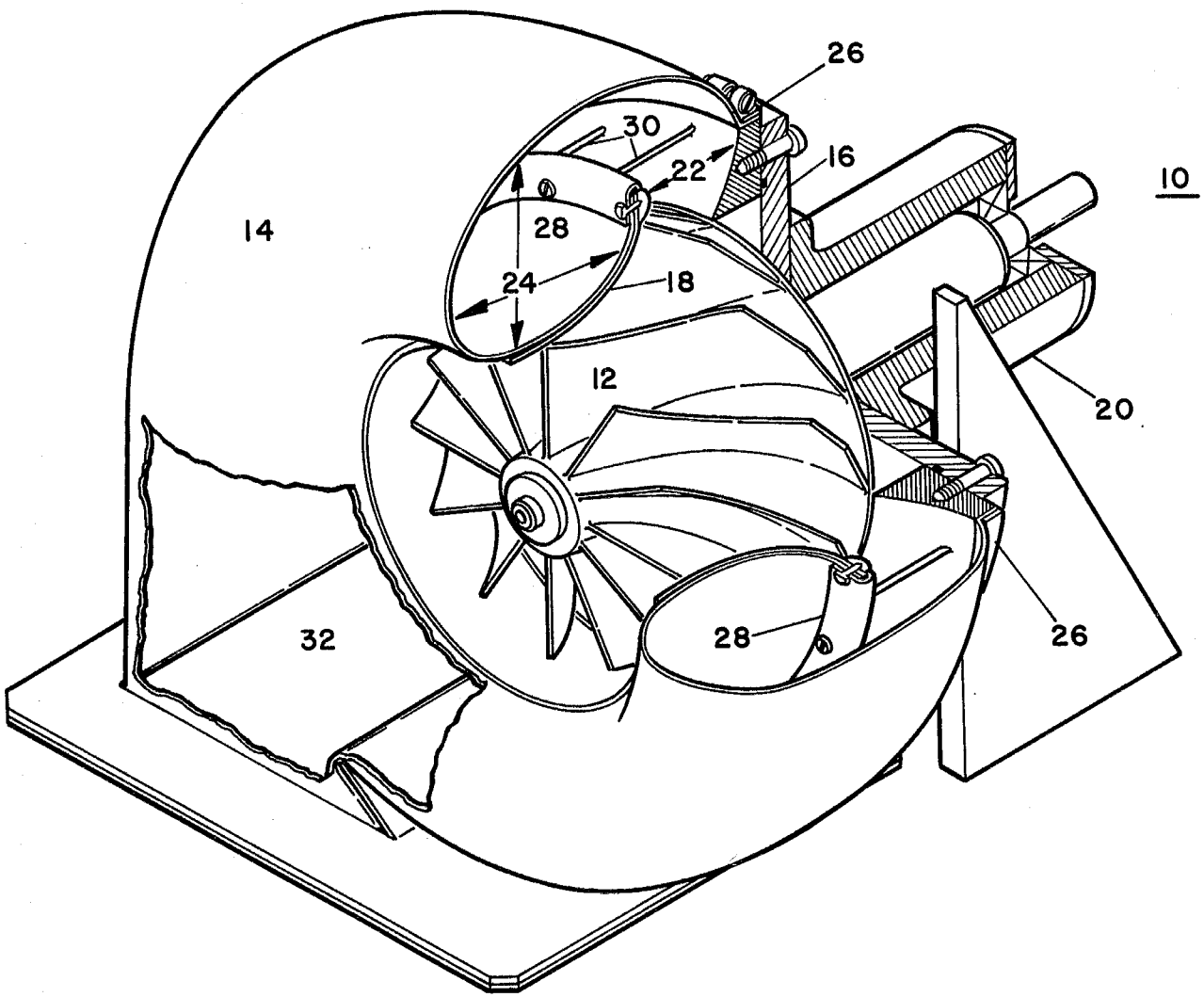
FIG. 2 is a partially cutaway schematic, perspective illustration of the fan shown in FIG. 1 in which the housing is shown in its fully inflated position.

FIGS. 1 and 2 both illustrate a fan 10 having a rotor or impeller 12 disposed in a housing comprised of a flexible surface 14 attached to and supported by a rigid disk shaped wall 16 and a shroud 18 that is connected to and supported by that wall 16. Impeller 12 is mounted in a bearing sleeve 20, and shaped such that its diameter increases with displacement away from the inlet side and toward wall 16 in order to provide a compact package and smooth air flow from inlet to discharge. Leakage or back flow between the impeller 12 and the housing is minimized by rigid attachment of the shroud 18 to the back wall 16 to provide a close tolerance flow path across the rotor 12; the formation of a limited area slot 22 between impeller 12 and the snail shell volute defined by surface 14; and the configuration of that volute as illustrated by FIG. 2 such that a substantial portion 24 of the flow path around impeller 12 is displaced laterally or axially from slot 22.

Flexible surface 14 is shaped such that its edges are circular, or more specifically encircle impeller 12, and is held in position by rings 26 and 28 which clamp the edges of surface 14 to back wall 16 and shroud 18. Attachment to shroud 18 is as near as practical to wall 16 to minimize the bending moment on shroud 18 during operation. Shroud 18 is secured to wall 16 by rods 30 that also assist in holding surface 14 away from impeller 12 when that surface is deflated. Wall 16 thus supports both flexible surface 14 and shroud 18, and also forms a portion of the housing surface. This simplifies and economizes the configuration and construction of fan 10.

Construction of the fan 10 is straightforward. It is generally desirable to cast mold the impeller 12 and form the flexible surface 14 by cutting and gluing individual sections of an economic, rubber, or rubber-like material such as a nitrile rubber backed nylon fabric, or other readily glueable elastomer for construction of either one or a small number of units because that can be accomplished without expensive equipment, and to mold surface 14 in one integral piece on a mandrel or other form from a readily moldable elastomer such as nitrile PVC, natural rubber, or chloroprene when higher volume production is desired.

The flexible surface or skin 14 assumes the collapsed position shown in FIG. 1 when the fan 10 is not in operation. The back wall 16, shroud 18, and the spacers 30 prevent that surface from falling into and becoming entangled in impeller 12. Operation is begun simply by initiating rotation of impeller 12. Rotation causes air to flow across that impeller, through gap 22 between wall 16 and shroud 18 to inflate surface 14 to the snail shell shaped form shown in FIG. 2. Air flows through slot 22 at all points around the circumference of impeller 12 into the volute formed by surface 14, and then through that volute to outlet 32.

Having thus provided this description, it will be obvious that many straightforward modifications can be readily made, and that many optional details are included in the embodiment 10. For example, the cross-sectional area of the flow path defined by surface 14 increases with displacement toward outlet 30. This increase accommodates constant flow rate performance by providing space for increase in the volume of air flow through volute path 26 with rotation about impeller 12 toward outlet 30. Constant velocity flow will not be desirable in all embodiments. Volutes with other smoothly curved toroidal/scroll forms that do not have an increasing cross-sectional area can be used in other embodiments. As a second example of an optional feature, flexible membrane 14 is shaped to extend slightly beyond the input edge of impeller 12 so that the outside surface of that membrane defines an inlet flow path to the impeller. This can increase performance in some embodiments, but is ineffective and not desirable in others. As a third example of a permitted modification, surface 14 can be extended to attach to rotor sleeve 20 instead of back wall 16, and that wall can then be replaced with a strut or other non solid structure for supporting shroud 18 and keeping surface 14 from falling into the impeller when the fan is not in use. As a fourth example of modification, the flexible housing of this invention can be used with impellers other than impeller 12 shown in the drawings. Many other modifications can also be made.

Therefore, what is claimed is:

1. An inflatable housing for a fan rotor comprising:

a collapsible surface having two circular edges; and support means maintaining said circular edges of said collapsible surface at positions spaced along the rotor axis of rotation such that the space between said edges forms a slot for receiving air flow from the rotor; wherein said collapsible surface is shaped to be inflatable during operation by air from the rotor into a volute that encircles said rotor and extends across said rotor in at least one axial direction from said slot.

2. The fan rotor housing of claim 1 in which said support means include:

a rigid disk shaped wall adjacent the rotor;

a shroud that is both supported by and spaced from said rigid disk shaped wall covering a portion of said rotor;

means fastening one of said circular edges of said collapsible surface to said rigid disk shaped wall; and means fastening the other of said circular edges of said collapsible surface to said shroud proximate said disk shaped wall.

* * * * *